US006952539B2

(12) United States Patent
Matsuura

(10) Patent No.: US 6,952,539 B2
(45) Date of Patent: Oct. 4, 2005

(54) IMAGE FORMING APPARATUS

(75) Inventor: Taisuke Matsuura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/780,684

(22) Filed: Feb. 19, 2004

(65) Prior Publication Data

US 2004/0165902 A1 Aug. 26, 2004

(30) Foreign Application Priority Data

Feb. 26, 2003 (JP) ..... 2003-049211
Jan. 27, 2004 (JP) ..... 2004-018356

(51) Int. Cl.[7] ..... G03G 15/16; G03G 15/20

(52) U.S. Cl. ..... 399/66; 399/44; 399/313; 399/314

(58) Field of Search ..... 399/44, 66, 97, 399/297, 313, 314

(56) References Cited

U.S. PATENT DOCUMENTS 5,450,180 A 9/1995 Ohzeki et al.
5,822,651 A * 10/1998 Yim et al. ..... 399/66
5,915,145 A * 6/1999 Shimura et al. ..... 399/66
6,266,495 B1 * 7/2001 Yuminamochi et al. ..... 399/66
6,782,215 B2 * 8/2004 Komori ..... 399/50

FOREIGN PATENT DOCUMENTS

JP 2-123385 5/1990
JP 5-181373 7/1993

* cited by examiner

*Primary Examiner*—Hoang Ngo
(74) *Attorney, Agent, or Firm*—Fitzpatrick, Cella, Harper & Scinto

(57) ABSTRACT

In an image forming apparatus having an image forming portion for forming an image on an image bearing member, a transferring portion provided with a transferring member capable of contacting with the image bearing member and a voltage applying portion for applying a voltage to the transferring member, and for electrostatically transferring the image on the image bearing member to a transferring medium, an electric current detecting portion for detecting an electric current flowing to the transferring member, and a control portion for performing an electric current detecting operation of detecting an electric current flowing when the voltage applying portion applies a predetermined voltage before an image transferring operation by the electric current detecting portion, and determining a transfer voltage applied to the transferring member during the image transferring operation on the basis of a result of the detection by the electric current detecting operation, the electric current detecting operation is performed a plurality of times, and a time required for an electric current detecting operation performed before a certain electric current detecting operation performed at and after the second time is shorter than a time required for the certain electric current detecting operation.

16 Claims, 8 Drawing Sheets

IMAGE FORMING APPARATUS

BACKGROUND OF THE INVENTION

1. Field of the Invention

This invention relates to an image forming apparatus such as a copying machine, a printer or a facsimile apparatus for effecting image forming by an electrophotographic process, an electrostatic recording process or the like.

2. Related Background Art

In a well-known image forming apparatus including the step of transferring a toner image formed on the surface of an image bearing member to a transferring material such as paper, there is put into practical use one designed such that the transferring material is passed to a transferring region formed on the portion of contact between the image bearing member and a transferring member such as a transferring roller brought into pressure contact therewith, and in timed relationship therewith, a transferring bias is applied to the transferring member, and by the action of an electric field formed by the applied transferring bias, the toner image on the surface of the image bearing member is shifted to the transferring material by the action of an electric field formed by the applied transferring bias.

The transferring roller has its resistance value adjusted to a value of the order of $1\times10^{6}$–$1\times10^{10}$ (Ω), but a transferring roller proposed in recent years, as shown in FIG. 3 of the accompanying drawings, has an elastic layer 118 provided on the outer peripheral surface of an electrically conductive mandrel 117, and this elastic layer 118 is given electrical conductivity. The transferring roller 116 is broadly classified into the following two kinds by the manner in which the elastic layer is given this electrical conductivity.

- a transferring roller having a material of an electron electrically conducting system, and
- a transferring roller having a material of an ion electrically conducting system.

The above-mentioned transferring roller, as shown in FIG. 3, has an elastic layer 118, and an electrically conductive filler is dispersed in this elastic layer 118, and as an example, mention can be made of an EPDM roller or a urethane roller having an electrically conductive filler such as carbon or a metal oxide dispersed therein.

Alternatively, mention may be made of a material including a material of the ion electrically conducting system in the elastic layer 118, for example, a material itself such as urethane given electrical conductivity, or an interfacial active agent dispersed in the elastic layer 118.

Also, it is known that the resistance of the transferring roller is liable to fluctuate in conformity with the temperature and humidity of the atmospheric environment, and it is feared that the fluctuation in the resistance of the transferring roller induces the arising of such problems as faulty transfer, explosive scatter and paper trace.

So, in order to prevent the occurrence of the faulty transfer and paper trace attributable to the fluctuation in the resistance of the transferring roller, there is adopted "applied transfer voltage control" measuring the resistance value of the transferring roller, and properly controlling a transferring voltage applied to the transferring roller in conformity with the result of the measurement.

A popular controlling method will be described later.

Now, in the transferring roller, there exists resistance unevenness in the direction of rotation thereof (hereinafter referred to as the "periphery unevenness"). This periphery unevenness becomes remarkable not only due to the nonuniformity of a roller resistance adjusting material, but also by being affected by partial changes in temperature and humidity. Specifically, it is the resistance difference by the temperature of a fixing apparatus between the region of the transferring roller opposed to a fixing roller and a side opposite thereto.

For example, when an electric current corresponding to one full rotation of the transferring roller is measured when the control of a certain constant voltage has been effected, the surface opposed to the fixing apparatus falls in the resistance value of the roller due to a high temperature, and becomes great in a current value flowing when a constant voltage is applied, as compared with a region which has not yet been warmed.

In order to avoid the inconvenience due to such a phenomenon, constant current control has been conceived, but for the following reason of phenomenon, constant voltage control is generally used.

To obtain a good transferring property at all times, it is ideal to control a charge amount supplied to a transferring region at a predetermined value, and for example, it is conceivable to constant-current-controlling the transferring roller. In the transferring region, however, the load impedance of the transferring roller to a photosensitive drum differs between a portion in which the transferring material is present and a portion in which the transferring material is absent, and the load impedance becomes small in the portion wherein the transferring material is absent.

Therefore, the width over which the transferring roller is in contact with the surface of the photosensitive drum at the transferring region is changed by a change in the size of the transferring material used, whereby much current concentratedly flows into the portion wherein the transferring material is absent, and faulty transfer is caused in the portion wherein the transferring material is present.

In contrast, if the constant voltage control is used, the same degree of charge amount is always supplied from the transferring roller differing in resistance value to the transferring region and therefore, a method which will hereinafter be described has been proposed.

So, in order to prevent the occurrence of faulty transfer and paper trace attributable to the fluctuation in the resistance of the transferring roller, there is adopted "applied transfer voltage control" for measuring the resistance value (voltage-current characteristic) of the transferring roller, and properly controlling a transferring voltage applied to the transferring roller in conformity with the result of the measurement.

As such applied transfer voltage control means, there is active transfer voltage control (ATVC) disclosed in Japanese Patent Application Laid-Open No. H2-123385.

The ATVC is means for optimizing a voltage applied to the transferring roller during transfer, and prevents the occurrence of faulty transfer and paper trace. The above-described transfer voltage is such that during the pre-multiple rotation step of the image forming apparatus, a desired constant current is applied from the transferring roller to the photosensitive drum, and the then voltage value is held to thereby detect the resistance of the transferring roller, and during the transfer at the printing step, a constant voltage conforming to that resistance value is applied as a transfer voltage to the transferring roller.

Also, as other applied transfer voltage control, mention may be made of programmable transfer voltage control (PTVC) disclosed in Japanese Patent Application Laid-Open No. H5-181373.

The ATVC effects the detection of the resistance of the transferring roller by constant current control, whereas the PTVC effects it by constant voltage control alone and therefore, a circuit therefor is simplified and detection accuracy is improved.

Particularly describing, the PTVC has means for applying a constant voltage during the detection of the resistance of the transferring roller, and detecting an output current value flowing to the photosensitive drum at this time, and when this current value is far from a set value, a constant voltage for detection is varied and outputted and the control is effected through software so that the set value may be obtained.

FIG. 2 of the accompanying drawings shows the construction of the PTVC. In FIG. 2, a PWM signal (DA value) having a pulse width corresponding to a desired transfer output voltage is first outputted from the OUT terminal of a CPU 101. Actually, a transfer output voltage table (not shown) corresponding to the pulse width is memorized in the CPU 101. This PWM signal is made into DC (analog) by a low-pass filter 102, is amplified by an amplifier 103 and becomes a transfer voltage TV. Next, voltage-current conversion is effected, and a signal corresponding to a current IT flowing at this time is inputted to the IN terminal of the CPU 101 after DA conversion, and is detected in the CPU 101.

As described above, the constant voltage control judges from the corresponding table of the PWM value preset in the CPU 101 and the transfer output voltage and outputs the PWM signal of a pulse width corresponding to the desired voltage value.

To accurately detect the resistance of the transferring roller by the above-described PTVC, and determine an optimum applied transfer voltage, the average current value corresponding to one full rotation of the transferring roller is monitored from the aforedescribed periphery unevenness of the transferring roller at a plurality of voltage values, and a target current is obtained from the relational expression of the current and the voltages. The resistance of the transferring roller has voltage dependency and therefore, the setting of such a voltage value that a value approximate to the voltage applied during transfer is generated is required. Consequently, it is usual that the PTVC, etc. are effected during pre-rotation having a surplus of time when carrying out an image forming process. So, in order to prevent the occurrence of faulty transfer, paper trace, etc., attributable to the fluctuation in the resistance of the transferring roller, there is adopted the "applied transfer voltage control" for measuring the resistance value of the transferring roller, and properly controlling a transfer voltage applied to the transferring roller in conformity with the result of the measurement.

According to the PTVC using the above-described conventional method, however, a plurality of voltage values corresponding to one full rotation of the transferring roller are applied and therefore, a time required for the detection of one full rotation of the transferring roller becomes necessary in conformity with the number of voltage levels applied during pre-rotation.

In the latest copying machines, there is the tendency toward shortening the first copy time, and it is also necessary to shorten the time required for the above-described control. Further, a higher image of quality has been advanced, and it is required to always obtain an optimum image by transfer control, and it is necessary to effect the above-described optimum control. For that purpose, it is necessary to effect the detection of one full rotation in the above-described control at plural levels of bias values, and determine an accurate bias for obtaining a necessary transfer current, but it is against the above-described tendency to shorten the first copy time to effect the detection of one full rotation of the transferring roller a plurality of times.

SUMMARY OF THE INVENTION

It is the object of the present invention to shorten the time required for the determination of a transferring bias, without debasing the accuracy of transfer control.

A preferred image forming apparatus for achieving the above object has:

image forming means for forming an image on an image bearing member;

transferring means for electrostatically transferring the image on the image bearing member to a transferring medium;

the transferring means being provided with a transferring member capable of contacting with the image bearing member, and voltage applying means for applying a voltage to the transferring member;

electric current detecting means for detecting an electric current flowing from the voltage applying means to the transferring member; and control means for performing an electric current detecting operation of detecting the electric current flowing when the voltage applying means applies a predetermined voltage before an image transferring operation of the transferring means by the electric current detecting means, and determining a transfer voltage applied to the transferring member during the image transferring operation, on the basis of a result of the detection by the electric current detecting operation; and is characterized in that the electric current detecting operation is performed a plurality of times, and a time required for an electric current detecting operation performed before a certain electric current detecting operation performed at and after the second time is shorter than a time required for the certain electric current detecting operation.

Another preferred image forming apparatus has:

image forming means for forming an image on an image bearing member;

transferring means for electrostatically transferring the image on the image bearing member to a transferring medium;

the transferring means being provided with a transferring member capable of contacting with the image bearing member, and electric current applying means for applying an electric current to the transferring member;

voltage detecting means for detecting a voltage applied to the transferring member by the electric current applying means; and control means for performing the voltage detecting operation of detecting the voltage applied when the electric current applying means applies a predetermined electric current before the image transferring operation of the transferring means by the voltage detecting means, and determining a transfer electric current applied to the transferring member during an image transferring operation on the basis of a result of the detection by the voltage detecting operation; and is characterized in that the voltage detecting operation is performed a plurality of times, and a time required for a voltage detecting operation performed before a certain voltage detecting operation performed at and after the second time is shorter than a time required for the certain voltage detecting operation.

DESCRIPTION OF THE PREFERRED EMBODIMENTS

Figure 1:
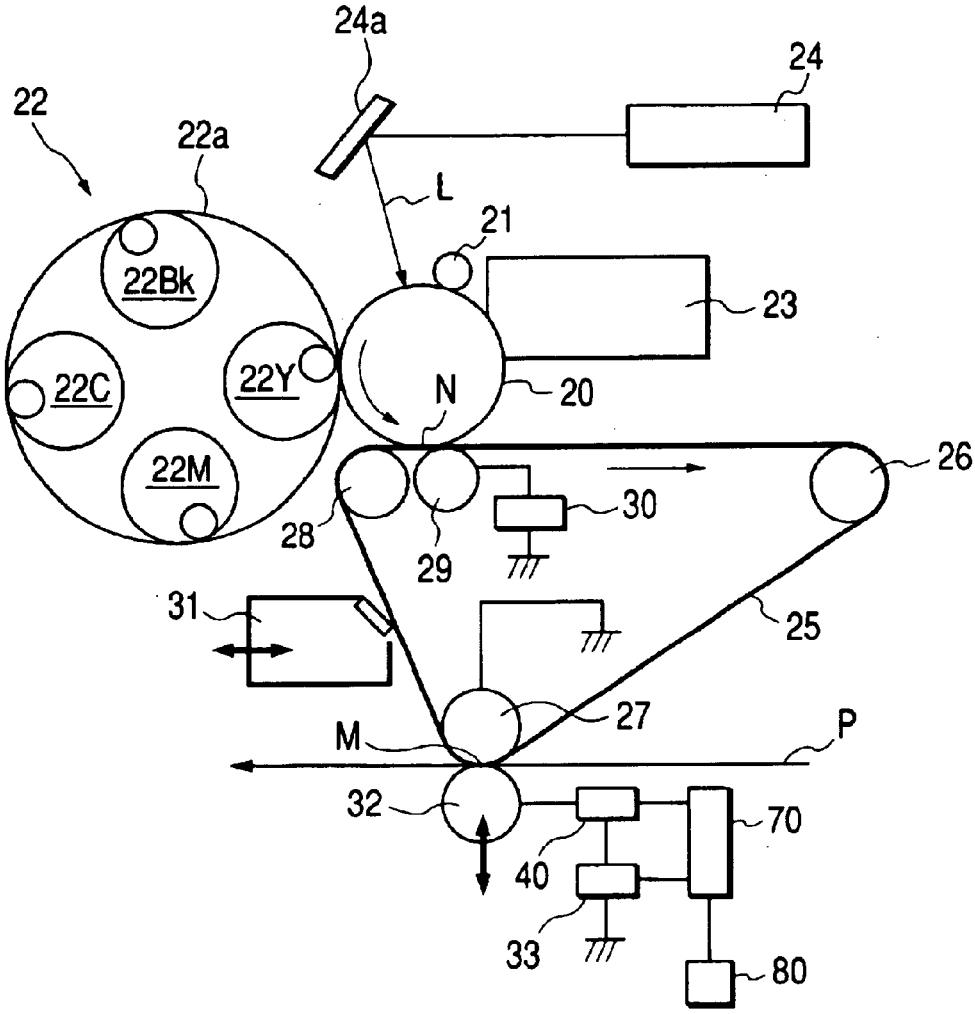
FIG. 1 shows an image forming apparatus according to a first embodiment of the present invention.
Figure 2:
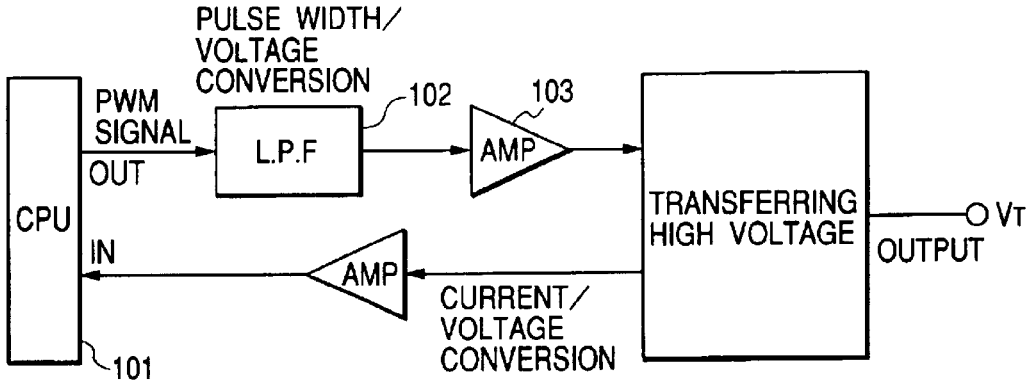
FIG. 2 is a control circuit diagram of PTVC.

The present invention will hereinafter be described with respect to some embodiments thereof shown in the drawings.

<First Embodiment>

FIG. 1 schematically shows the construction of an image forming apparatus according to a first embodiment of the present invention. In the present embodiment, there is shown an image forming apparatus such as a laser beam printer provided with an intermediate transferring member (intermediate transferring belt) for forming a color image by the utilization of an electrophotographic process.

In this image forming apparatus, a photosensitive drum 20 rotated at a predetermined process speed (e.g., 117 mm/sec.) in the direction of arrow (counter-clockwise direction) is uniformly electrified by an electrifying roller 21. Scanning exposure L by a laser beam modulated correspondingly to an inputted image signal is given from an exposing apparatus (laser scanner) to the uniformly electrified surface of the photosensitive drum 20 through the intermediary of a reflecting mirror 24*a*, whereby electrostatic latent images of respective colors corresponding to image information are formed.

Then, among a yellow developing device 22Y, a magenta developing device 22M, a cyan developing device 22C and a black developing device 13K containing therein yellow, cyan, magenta and black toners, respectively, and carried on the rotary member 22*a* of a developing apparatus 22, a developing device of a first color (in FIG. 1, the yellow developing device 22Y is moved to a developing position opposed to the photosensitive drum 20 by the rotation of the rotary member 22*a*, and a developing bias of the same polarity as the electrified polarity (negative polarity) of the photosensitive drum 20 is applied to the yellow developing device 22Y, whereby a yellow toner is caused to adhere to the electrostatic latent image on the photosensitive drum 20 to thereby develop it as a yellow toner image.

This yellow toner image is primary-transferred onto an intermediate transferring belt 25 as an intermediate transferring member at a primary transfer nip part N by a primary transferring roller 29 to which a primary transferring bias (opposite in polarity to the toner) has been applied from a primary transferring high voltage source 30. At this time, a secondary transferring roller 32 is spaced apart from the intermediate transferring belt 25 and a secondary transferring opposed roller 27 at a secondary transfer nip part M. When this primary transfer is terminated, any residual toner on the photosensitive drum 20 is removed by a drum cleaning apparatus 23.

When the primary transfer of the yellow toner image which is the first color image is terminated, the rotary member 22*a* of the developing apparatus 22 is rotated and the next developing device is moved to the developing position opposed to the photosensitive drum 20, and in the same manner as in the case of yellow, the forming, developing and primary transfer of the electrostatic latent images and the cleaning operation are successively performed with respect to the respective colors, i.e., magenta, cyan and black, and toner images of the four colors are successively superimposed on the intermediate transferring belt 25 to thereby form a full-color toner image thereon.

When the leading edge of the full-color toner image formed on the intermediate transferring belt 25 then arrives at the secondary transfer nip part M between the secondary transferring roller 32 and the secondary transferring opposed roller 27, a transferring material P such as paper is fed to the secondary transfer nip part M in timed relationship therewith.

Then, at the secondary transfer nip part M, the secondary transferring roller 32 to which a secondary transferring bias has been applied from a secondary transferring high voltage source 33 with the grounded secondary transferring opposed roller 27 as an opposed electrode is pivotally moved so as to contact with the secondary transferring opposed roller 27 with the intermediate transferring belt 25 interposed therebetween. A transferring bias opposite in polarity to the toners is then applied from the secondary transferring roller 32 to the back of the transferring material P conveyed to the secondary transfer nip part M, whereby the full-color toner image borne on the intermediate transferring belt 25 is collectively transferred (secondary-transferred) to the surface of the transferring material P.

A voltage is applied to the secondary transferring roller 32 by a constant voltage source 33, and an electric current flowing to the transferring roller at that time is detected by electric current detecting means 40. The control of the transfer is effected by control means 70.

After the secondary transfer, the transferring material P is heated and pressurized by a fixing apparatus (not shown), and is delivered to the outside after the full-color toner image has been heat-fixed on the transferring material P, thus completing a series of image forming operations. Also, any residual toners residual on the intermediate transferring belt 25 after the secondary transfer are removed by the belt cleaning apparatus 31.

Now, the toner of each color used in the above-described embodiment is a toner of the negative polarity having triboelectricity of −25 $\mu$c/g in ordinary environment, and the photosensitive drum 20 electrified to the negative polarity has a diameter of 47 mm, and is used at electrification potential (dark potential): −550V, exposure potential (light potential): −150V.

The intermediate transferring belt 25 is passed over a drive roller 26, the secondary transferring opposed roller 27 and a tension roller 28, and is rotated in the direction of arrow (clockwise direction) by the rotative driving of the drive roller 26. The drive roller 26 comprises a mandrel and a surface layer of a rubber material provided thereon. Also, the intermediate transferring belt 25 is a single-layer seamless resin belt having a thickness of 75 μm, a circumferential length of 1860 mm and a longitudinal length of 310 mm, and is formed of polyimide subjected to resistance adjustment by carbon dispersion. The volume resistivity ρv of the intermediate transferring belt 25 used in the present embodiment is $10^9$ Ωcm during the application of 100V.

The primary transferring roller 29 is formed of electrically conductive urethane foamed foam, and has a foam layer having a thickness of 4 mm formed on an SUS mandrel having a diameter of 8 mm, and has an outer diameter of 16 mm. The resistance value of the primary transferring roller 29 was a value of the order of $5\times10^6$–$3\times10^7$ Ω as a result of having been driven to rotate at a peripheral speed of 50 mm/sec relative to a rotary aluminum cylinder grounded under a load of 4.9N at each end thereof, and calculated from the relation of an electric current measured under the application of a voltage of 100V to the mandrel thereof.

The secondary transferring roller 32 is composed of electrically conductive NBR or hydrin rubber, and has a foam layer having a thickness of 3 mm formed on an SUS mandrel having a diameter of 10 mm, and has an outer diameter of 24 mm. The resistance value of the secondary transferring roller 32 was a value of the order of $1\times10^7$–$1\times10^8$ Ω as a result of having been driven to rotate at a peripheral speed of 50 mm/sec relative to a rotary aluminum cylinder grounded under a load of 4.9N at each end thereof, and calculated from the relation of an electric current measured under the application of a voltage of 100V to the mandrel thereof.

The secondary transferring opposed roller 27 is also formed of electrically conductive rubber, and comprises an SUS mandrel having a diameter of 20 mm and a rubber layer formed to a thickness of 6 mm thereon, and has an outer diameter of 32 mm. The resistance value of the secondary transferring opposed roller 27 is a value of $1\times10^7$ Ω or less.

Figure 4:
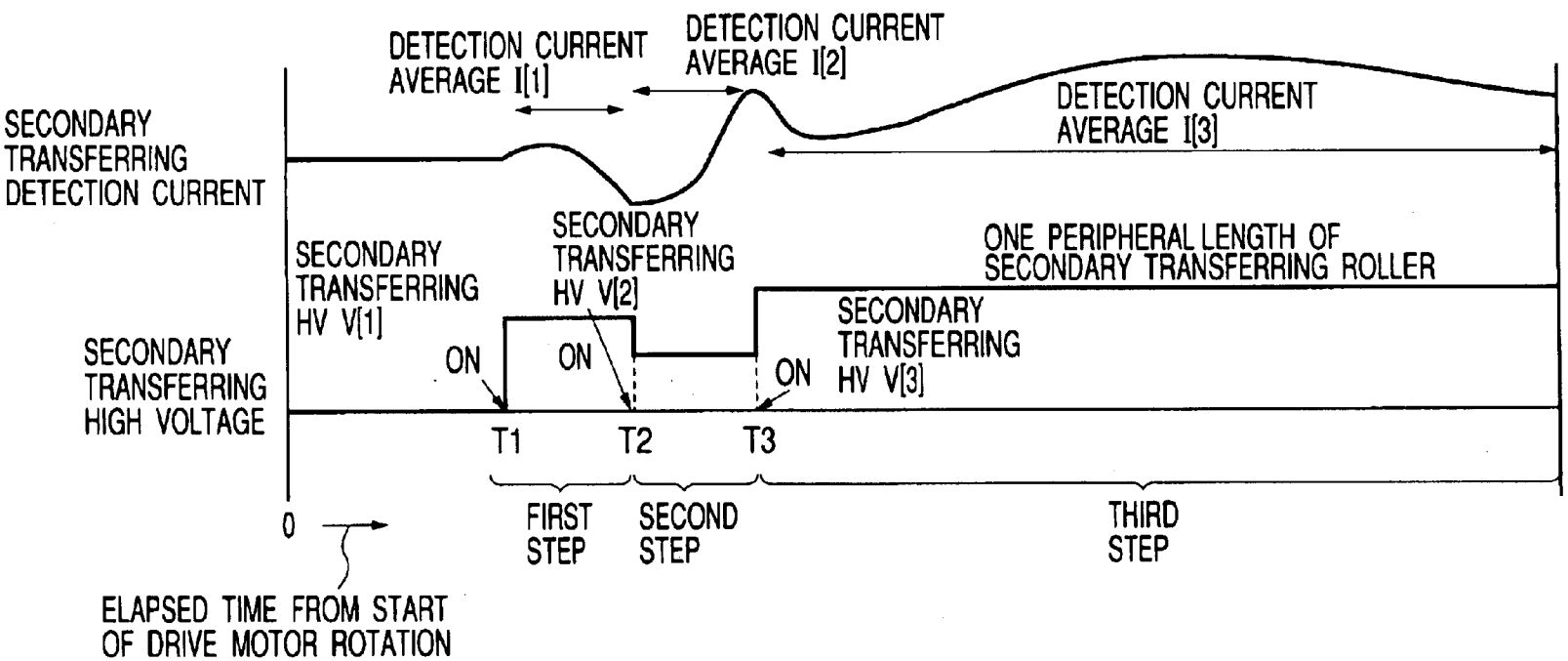
FIG. 4 is a sequence chart of the PTVC of the present invention.

Description will now be made of PTVC during the transferring operation in the present embodiment. FIG. 4 is a sequence chart of the control.

The resistance value of the transferring roller 32 of the present invention is varied by the temperature/humidity of the atmosphere. The electric current necessary during proper image forming is also varied by the temperature and humidity of the atmosphere and therefore, the voltage to be applied to the transferring roller 32 is also varied.

So, in the present invention, an environment table conforming to the temperature and humidity of the atmosphere is provided in a memory, not shown, and for each environment, a target current value It (i.e., an electric current applied during image forming or a reference current for obtaining it) necessary during transfer, and a voltage value standardly necessary to let it flow are stored therein.

The PTVC during the transferring operation in the present embodiment will now be described with reference to FIGS. 4 and 5.

The PTVC of the present embodiment is divided into three steps, which will hereinafter be described in succession.

(First Step)

FIG. 4 is a schematic sequence chart of the PTVC of the present invention.

From a certain time T1 till T2, a voltage V1 is applied to the transferring roller 32 by the constant voltage source 33. An electric current flowing to the secondary transferring opposed roller through the intermediate transferring belt at that time is detected by a current detecting circuit 40. This detection is limited to three times for 4 msec. each in order to shorten the measuring time so that it can be effected within a time corresponding to less than one full rotation of the transferring roller, and three measurement values are averaged and average is used as a first detection current I1.

Figure 5:
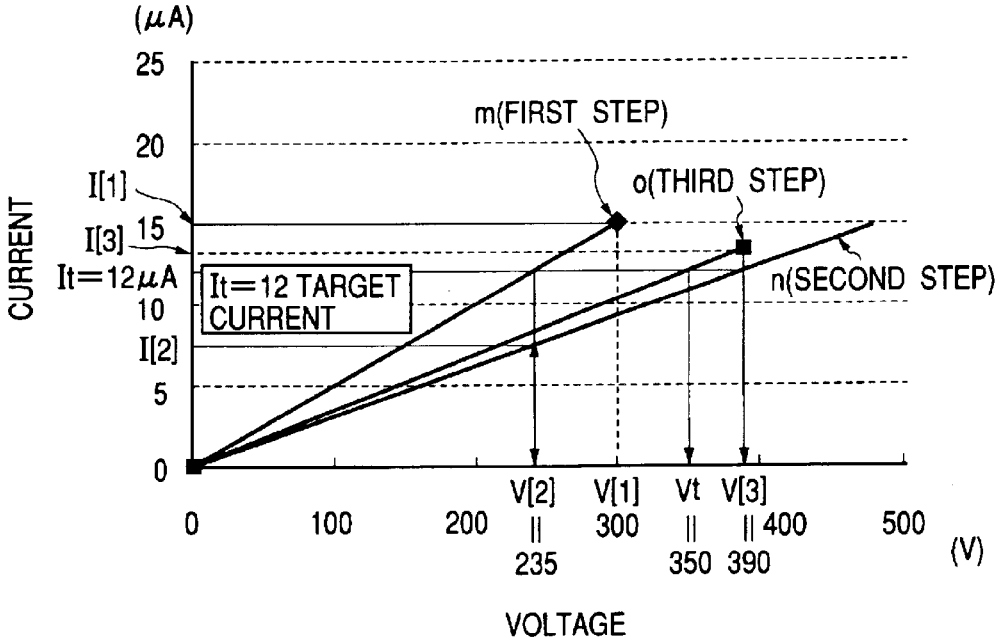
FIG. 5 is a detailed graph for finding the transfer voltage of the PTVC of the present invention.

FIG. 5 is a graph illustrating a flow for determining the applied voltage at the next step in the PTVC of the present invention.

A case where I1=15 μA when e.g., 300V has been applied as V1 is written as an example. If a target current It=12 μA, as shown in FIG. 5, a voltage V2 (in this example, 235V) necessary to make the detection current into 12 μA can be found from a straight line m linking the origin and a point (V1, I1) together.

(Second Step)

From the time T2 till T3, the voltage V2 found from the first step is applied to the transferring roller 32.

An electric current flowing to the secondary transferring opposed roller through the intermediate transferring belt 25 at this time as at the first step is detected by the current detecting circuit 40. This detection is effected three times for 4 msec. each as at the first step, and, three measurement values are averaged and the average is used as a second detection current I2.

It is not requisite that the number of times of the detection at the second step is the same as that at the first step, but the aforementioned number of times can be increased or decreased as required. It is desirable that the second detection current I2 coincide with the aforedescribed It, but at the first step executed immediately after the start of a high voltage output, the stability of the output voltage of the voltage source is usually insufficient and therefore, the second detection current I2 usually does not coincide with It.

In the example shown in FIG. 5, I2=7 μA, and from a straight line n linking the origin and a point (V2, I2) together, a voltage V3 (in this example, 390V) necessary to make the detection current into 12 μA which is the target current It can be found.

(Third Step)

For the time from a time T3 until the transferring roller 32 makes substantially one full rotation, the voltage V3 found in the manner described above is applied to the transferring roller 32. An electric current flowing to the secondary transferring opposed roller through the intermediate transferring belt 25 at this time as at the first step and the second step is detected by the current detecting circuit. This detection is effected for 4 msec. each at timing equally divided into 64 for one full rotation of the roller. Measurement values at these 64 points are averaged and the average is defined as a third detection current I3.

In the example shown in FIG. 5, I3=13 μA and from a straight line o linking the origin and a point (V3, I3) together, a voltage Vt (in this example, 350V) necessary to make the detection current into 12 μA which is the final transferring target current It can be found.

Thereby, a necessary voltage for obtaining the target current by the uneven resistance of the transferring roller 32 corresponding to the circumferential direction thereof can be obtained at the period of the transferring roller.

By this control being effected, the periodic unevenness of the current affected by the uneven resistance of the transferring roller 32 in the circumferential direction thereof appearing when a constant voltage according to the conventional method when the transferring material P has been supplied can be mitigated.

When as the transferring roller 32, use is made of an electronically conductive one, for example, one formed of EPDM (triple copolymer of ethylene propylene diene) or the like in which zinc oxide is dispersed as an electrically conductive filler, the uneven resistance of the transferring roller 32 in the circumferential direction thereof is liable to occur, and to effect voltage control of high accuracy, it is of course desirable to use an ion electrically conductive transferring roller 32 formed of the aforedescribed NBR, hydrin rubber or a material such as urethane which will be described later, and relatively small in the uneven resistance in the circumferential direction, and small in an amount of variation when a voltage corresponding to one full rotation of the transferring roller 32 is controlled.

Also, as the value of the aforementioned voltage V1 and the target current value, use is made of values conforming to the temperature and humidity state detected by a temperature and humidity sensor 80 provided in an apparatus main body or the like, more accurate transfer control can be effected.

In the above-described detection, as compared with a case where the detection of one full rotation or more according to the conventional method was effected by a plurality of voltage values, similar control accuracy could be obtained without a difference occurring to the final applied voltage.

<Second Embodiment>

An image forming apparatus according to a second embodiment of the present invention will hereinafter be described.

The image forming apparatus according to the second embodiment is similar to the image forming apparatus according to the first embodiment of the present invention, and the construction and image forming operation of the apparatus need not be described, but description will be made of only the applied voltage control (PTVC) from the secondary transferring high voltage source 33 to the secondary transferring roller 32.

A specific method will hereinafter be described, but the sequence of control for determining the transferring voltage and the control during sheet supply are similar to the case of the PTVC in the first embodiment.

In the present embodiment, the timing at which a fixed voltage V(1) to be first applied at the start of the control is applied was substantially simultaneous with the start of the driving operation of the photosensitive drum and the intermediate transferring member. Usually, for the stability of detection accuracy, detection control is started after the stabilization of the ordinary driving operation of the transferring member, but in the present embodiment, control was started before the stabilization of the driving operation.

The relation between the voltage and current applied at this time did not differ from that during the stabilization of the operation, and an effect equal to that of the first embodiment could be obtained.

Further, by the PTVC in the second embodiment, in addition to the effect of the first embodiment, the time required from the start of the operation till the stabilization of the operation can be shortened, and the first copy speed can be further shortened, whereby an effect similar to that of the first embodiment can be obtained.

<Third Embodiment>

An image forming apparatus according to a third embodiment of the present invention will hereinafter be described.

The image forming apparatus according to the third embodiment is similar to the image forming apparatus according to the first embodiment of the present invention, and the construction and image forming operation of the apparatus need not be described, but description will be made of only the applied voltage control (PTVC) from the secondary transferring high voltage source 33 to the secondary transferring roller 32.

Figure 6:
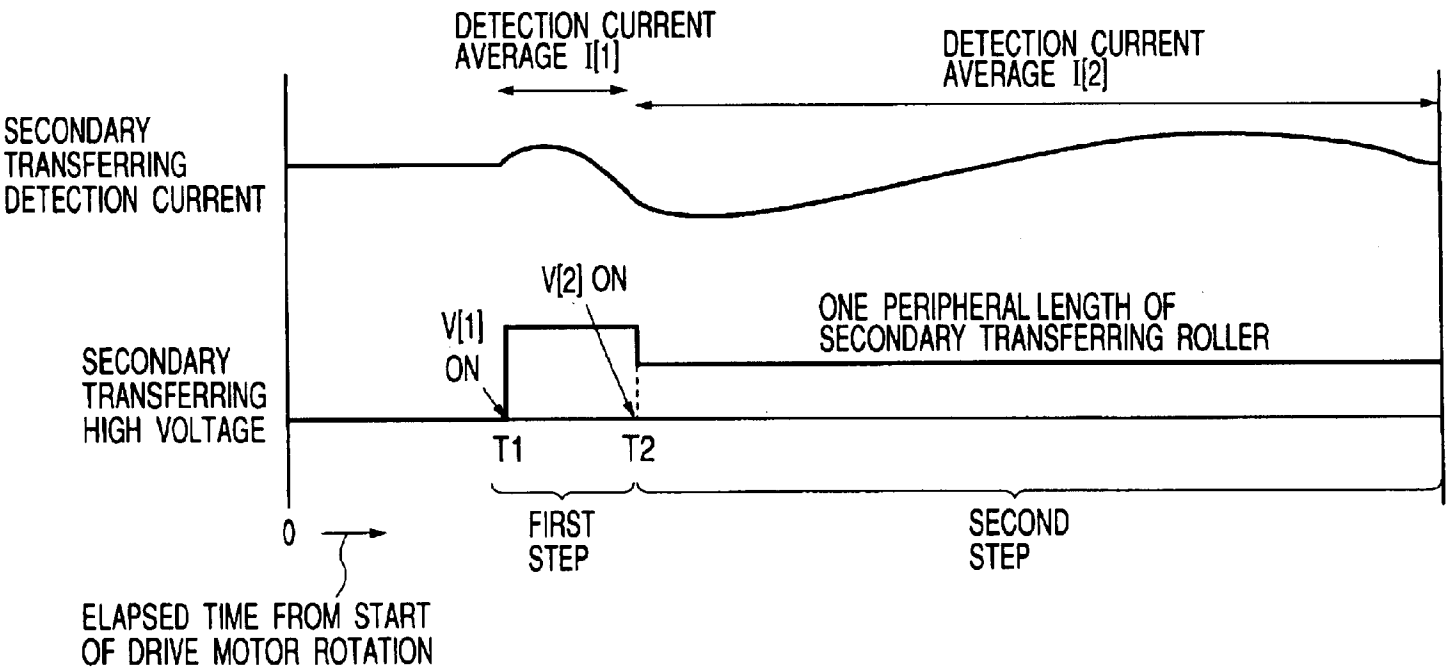
FIG. 6 is a sequence chart of PTVC according to a third embodiment of the present invention.
Figure 7:
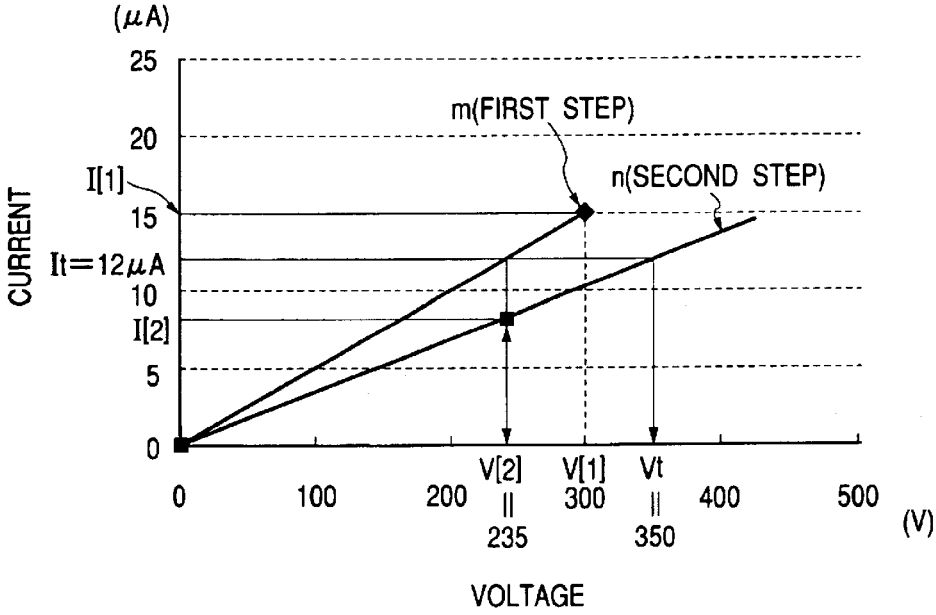
FIG. 7 is a detailed graph for finding the transfer voltage of the PTVC according to the third embodiment of the present invention.

The sequence of the control for determining the transferring voltage in the present embodiment is basically the same as the PTVC of the first embodiment, but in the first embodiment, the short current detecting operation within one full rotation of the roller was effected twice, whereas the present embodiment is characterized in that it is effected once. That is, as shown in FIGS. 6 and 7, an applied voltage V2 corresponding to one full rotation is determined from the detection of I(1) by the application of V(1), and a transferring voltage for the final target current is obtained. By the present embodiment, relative to the first embodiment, the time required for control can be shortened by about 190 msec.

The PTVC of the present invention is divided into two steps, which will hereinafter be described in succession.

(First Step)

FIG. 6 is a schematic sequence chart of the PTVC of the present invention.

From a certain time T1 till T2, a voltage V1 is applied to the transferring roller 32 by the voltage source 33. An electric current flowing to the secondary transferring opposed roller through the intermediate transferring belt 25 at this time is detected by the current detecting circuit. This detection is limited to three times for 4 msec. each in order to shorten the measuring time so that it can be effected within a time corresponding to less than one full rotation of the transferring roller, and three measurement values are averaged and the average is used as the first detection current I1.

FIG. 7 is a graph illustrating a flow for determining the applied voltage at the next step in the PTVC of the present invention.

A, case where I1=15 $\mu$A when e.g., 300V was applied as V1 is written as an example. Assuming that the target current It=12 $\mu$A, as shown in FIG. 7, from a straight line m linking the origin and a point (V1, I1) together, a voltage V2 (in this example, 235V) necessary to make the detection current into 12 $\mu$A can be found.

(Second Step)

For the time from the time 2 until the transferring roller 32 makes substantially one full rotation, the voltage V2 found in the manner described above is applied to the transferring roller 32. An electric current flowing to the secondary transferring opposed roller through the intermediate transferring belt 25 at this time as at the first step is detected by the current detecting circuit 40. This detection is effected for 4 msec. each at timing equally divided into 64 for one full rotation of the roller. The measurement values at these 64 points are averaged and the average is defined as a second detection current I2.

Figure 3:
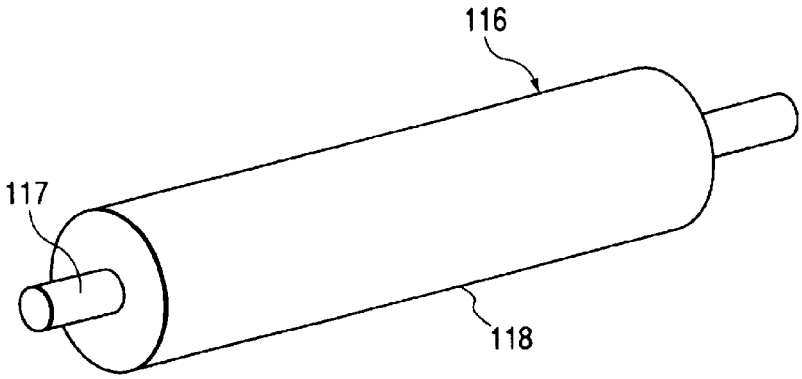
FIG. 3 is a perspective view of the transferring member of the present invention.

In the example shown in FIG. 3, I2=8 $\mu$A, and from a straight line n linking the origin and a point (V2, I2), a voltage Vt (in this example, 350V) necessary to make the detection current into 12 $\mu$A which is the final transferring target current It can be found.

As described above, even in a machine wherein the first copy time is short, an optimum transferring bias can be controlled without being affected by uneven periphery.

While the current detecting operation for less than one full rotation of the transferring roller is performed twice in the first embodiment, and once in the third embodiment, these are merely illustrative examples, and the number of times can be suitably set in conformity with the characteristic of the image forming apparatus.

<Fourth Embodiment>

Figure 8:
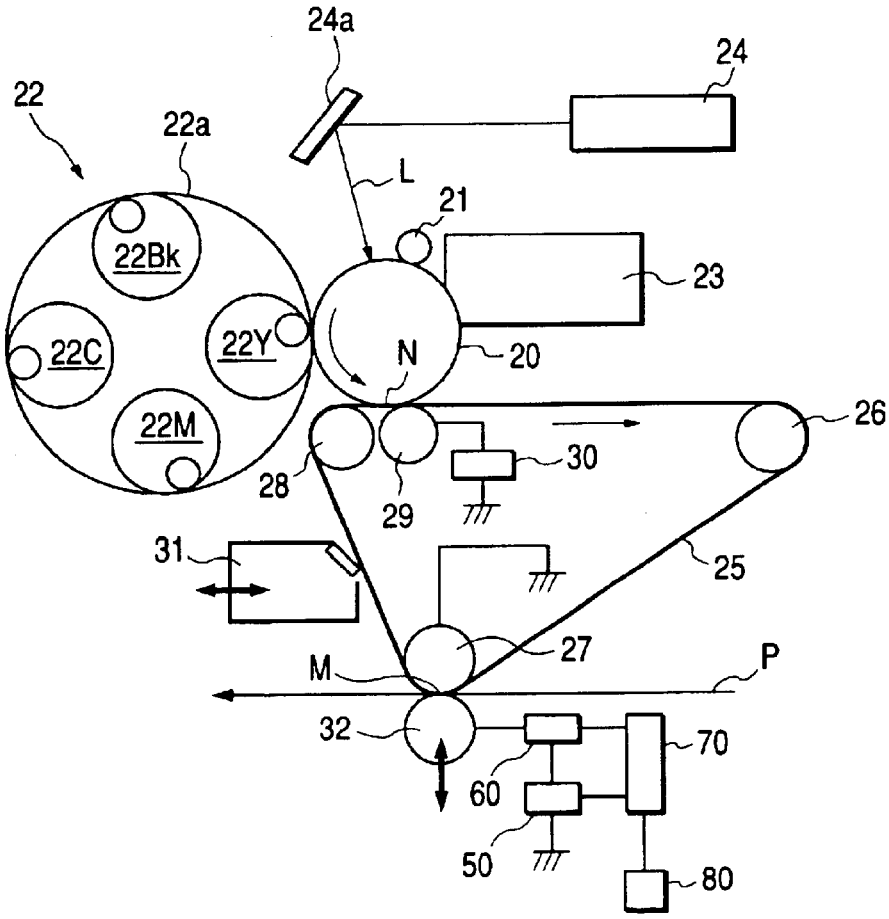
FIG. 8 shows an image forming apparatus according to a fourth embodiment of the present invention.

In the aforedescribed first to third embodiments, description has been made of a construction in which the voltage-current characteristic of the transferring roller is detected, and the transferring voltage value during transfer is determined on the basis of the result of the detection to thereby effect constant voltage control. The idea of the present invention, however, can likewise be applied in an apparatus wherein constant current control is effected during transfer. That is, the reference numeral 50 in the apparatus of FIG. 8 designates a constant current source, and the applied voltage during the application of a predetermined current is detected by voltage detecting means 60 to thereby detect the voltage-current characteristic of the transferring roller, and by the result of the detection, the present invention can also be applied to an image forming apparatus in which the constant current value during transfer is determined by control means 70. In FIG. 8, the same construction as that of FIG. 1 need not be described.

An example thereof will be shown below. The transfer control of the present embodiment is shown as an example in which it is divided into two steps. Basically, this is the same way of view as that of the previous third embodiment, and the relation between the voltage and the current can be replaced and utilized.

(First Step)

Figure 9:
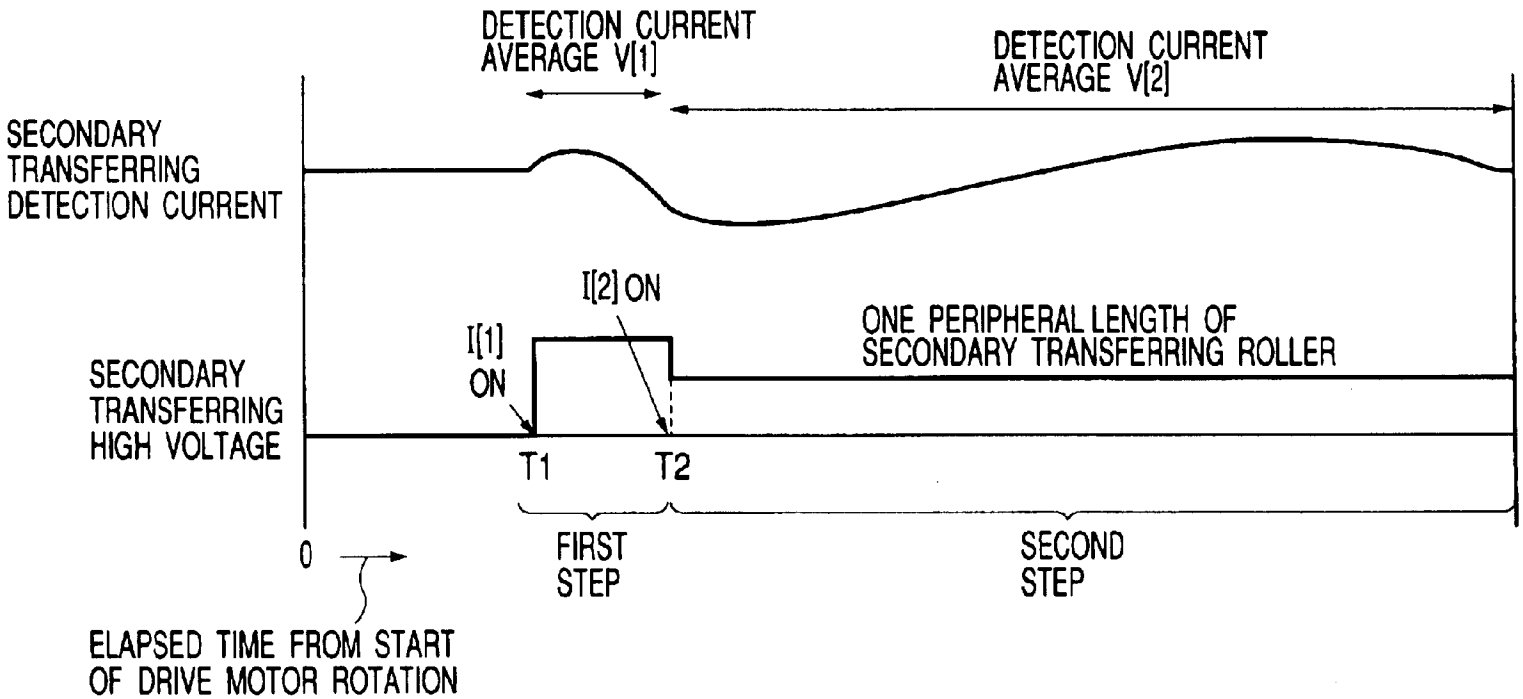
FIG. 9 is a sequence chart of PTVC according to the fourth embodiment of the present invention.

FIG. 9 is a schematic sequence chart of the transfer control of the present invention.

From a certain time T1 till T2, an electric current I1 is applied to the transferring roller 32 by the constant current source 33. A voltage applied to the secondary transferring opposed roller through the intermediate transferring belt 25 at that time is detected by the voltage detecting circuit 40. This detection is limited to three times for 4 msec. each in order to shorten the measuring time so that it can be effected within a time corresponding to less than one full rotation, and three measurement values are averaged and the average is defined as a first detection voltage V1.

An electric current I2 necessary to obtain a transferring target voltage is found from a straight line linking the origin and a point (V1, I1) together.

(Second Step)

For the time from the time 2 until the transferring roller 32 makes substantially one full rotation, the current I2 found in the manner described above is applied to the transferring roller 32. An electric current flowing to the secondary transferring opposed roller through the intermediate transferring belt 25 at this time as at the first step is detected by the voltage detecting circuit 60. This detection is effected for 4 msec. each at the timing equally divided into 64 for one full rotation of the roller. The measurement values at these 64 points are averaged and the average is defined as a second detection voltage V2.

A transferring current It necessary to make the detection voltage equal to the transferring target voltage can be found from a straight line linking the origin and a point (V2, I2) together.

Constant current control is effected at the value of this It to thereby perform the transferring operation.

While in the above-described first to fourth embodiments, description has been made of an example of the secondary transferring portion in the image forming apparatus using the intermediate transferring member, the present invention is not restricted to this form. Of course, the present invention can also be applied, for example, to a transferring portion in an image forming apparatus in which an image is directly transferred from a photosensitive member which is an image bearing member to a transferring material which is a transferring medium.

What is claimed is:

1. An image forming apparatus having:

image forming means for forming an image on an image bearing member;

transferring means for electrostatically transferring the image on said image bearing member to a transferring medium;

said transferring means being provided with a transferring member capable of contacting with said image bearing member, and voltage applying means for applying a voltage to said transferring member;

electric current detecting means for detecting an electric current flowing from said voltage applying means to said transferring member; and control means for performing an electric current detecting operation of detecting the electric current flowing when said voltage applying means applies a predetermined voltage before an image transferring operation of said transferring means by said electric current detecting means, and determining a transfer voltage applied to said transferring member during the image transferring operation, on the basis of a result of the detection by said electric current detecting operation;

wherein said electric current detecting operation is performed a plurality of times, and a time required for an electric current detecting operation performed before a certain electric current detecting operation performed at and after the second time is shorter than a time required for said certain electric current detecting operation.

2. An image forming apparatus according to claim 1, wherein a second voltage applied during said certain electric current detecting operation is determined on the basis of a current value detected when a first voltage is applied in the electric current detecting operation performed before said certain electric current detecting operation, and said transfer voltage is determined on the basis of the result of the electric current detection during the application of said second voltage.

3. An image forming apparatus according to claim 2, wherein a voltage-current characteristic of said transferring member is judged on the basis of the current value detected during the application of said first voltage, and said second voltage is determined so that a target current value may be obtained in said voltage-current characteristic, and the voltage-current characteristic of said transferring member is again judged on the basis of the current value detected during the application of said second voltage, and said transfer voltage is determined so that said target current value may be obtained in said voltage-current characteristic.

4. An image forming apparatus according to claim 1, wherein said transferring member comprises a rotary member, and a time required for said certain electric current detecting operation is equal to or longer than a time for which said rotary member makes one rotation.

5. An image forming apparatus according to claim 1, wherein said transferring member comprises a rotary member, and a time required for the electric current detecting operation performed before said certain electric current detecting operation is less than a time for which said rotary member makes one rotation.

6. An image forming apparatus according to claim 2, further having temperature and humidity detecting means for detecting a temperature and humidity state, and wherein a value conforming to detected temperature and humidity information is used as said first voltage.

7. An image forming apparatus according to claim 3, further having temperature and humidity detecting means for detecting a temperature and humidity state, and wherein a conforming to detected temperature and humidity information is used as said target current value.

8. An image forming apparatus according to claim 1, wherein the electric current detecting operation performed before said certain electric current detecting operation is performed substantially simultaneously with the start of the movement of said image bearing member.

9. An image forming apparatus having:

image forming means for forming an image on an image bearing member;

transferring means for electrostatically transferring the image on said image bearing member to a transferring medium;

said transferring means being provided with a transferring member capable of contacting with said image bearing member, and electric current applying means for applying an electric current to said transferring member;

voltage detecting means for detecting a voltage applied to said transferring member by said electric current applying means; and control means for performing the voltage detecting operation of detecting the voltage applied when said electric current applying means applies a predetermined electric current before an image transferring operation of said transferring means by said voltage detecting means, and determining a transfer electric current applied to said transferring member during an image transferring operation on the basis of a result of the detection by said voltage detecting operation;

wherein said voltage detecting operation is performed a plurality of times, and a time required for a voltage detecting operation performed before a certain voltage detecting operation performed at and after the second time is shorter than a time required for said certain voltage detecting operation.

10. An image forming apparatus according to claim 9, wherein a second electric current applied during said certain voltage detecting operation is determined on the basis of a voltage value detected when a first electric current is applied in the voltage detecting operation performed before said certain voltage detecting operation, and said transfer electric current is determined on the basis of a result of the voltage detection during the application of said second electric current.

11. An image forming apparatus according to claim 10, wherein a voltage-current characteristic of said transferring member is judged on the basis of a voltage value detected during the application of said first electric current, and said second electric current is determined so that a target voltage value may be obtained in said voltage-current characteristic, and the voltage-current characteristic of said transferring member is again judged on the basis of a voltage value detected during the application of said second electric current, and said transfer electric current is determined so that said target voltage value may be obtained in said voltage-current characteristic.

12. An image forming apparatus according to claim 9, wherein said transferring member comprises a rotary member, and a time required for said certain voltage detecting operation is equal to or longer than a time for which said rotary member makes one rotation.

13. An image forming apparatus according to claim 9, wherein said transferring member comprises a rotary member, and a time required for the voltage detecting operation performed before said certain voltage detecting operation is less than a time for which said rotary member makes one rotation.

14. An image forming apparatus according to claim 10, further having temperature and humidity detecting means for detecting a temperature and humidity state, and wherein a value conforming to detected temperature and humidity information is used as said first electric current.

15. An image forming apparatus according to claim 11, further having temperature and humidity detecting means for detecting a temperature and humidity state, and a value conforming to detected temperature and a humidity information is used as said target voltage value.

16. An image forming apparatus according to claim 9, wherein the electric current detecting operation performed before said certain voltage detecting operation is performed substantially simultaneously with the start of the movement of said image bearing member.

* * * * *

UNITED STATES PATENT AND TRADEMARK OFFICE

CERTIFICATE OF CORRECTION

PATENT NO. : 6,952,539 B2
DATED : October 4, 2005
INVENTOR(S) : Taisuke Matsuura It is certified that error appears in the above-identified patent and that said Letters Patent is hereby corrected as shown below:

Column 10,
Line 33, “A,” should read -- A --.

Column 11,
Line 6, “That is,” should read -- ¶That is, --.

Column 13,
Line 4, “a conforming” should read -- a value conforming --.

Signed and Sealed this

Twenty-first Day of February, 2006

JON W. DUDAS
*Director of the United States Patent and Trademark Office*